US009745807B2

(12) United States Patent
Bingham et al.

(10) Patent No.: US 9,745,807 B2
(45) Date of Patent: Aug. 29, 2017

(54) PROCESS FOR MIXING WELLBORE FLUIDS

(71) Applicant: M-I L.L.C., Houston, TX (US)

(72) Inventors: Richard Bingham, Katy, TX (US); Diana Garcia, Houston, TX (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 14/142,164

(22) Filed: Dec. 27, 2013

(65) Prior Publication Data

US 2014/0185406 A1 Jul. 3, 2014

Related U.S. Application Data

(62) Division of application No. 11/842,506, filed on Aug. 21, 2007, now Pat. No. 8,622,608.

(60) Provisional application No. 60/823,346, filed on Aug. 23, 2006.

(51) Int. Cl.

| | |
|---|---|
| ***E21B 21/00*** | (2006.01) |
| ***E21B 21/06*** | (2006.01) |
| ***B01F 3/04*** | (2006.01) |
| ***B01F 3/08*** | (2006.01) |
| ***B01F 5/04*** | (2006.01) |
| ***B01F 5/10*** | (2006.01) |

(52) U.S. Cl.

CPC ..... *E21B 21/062* (2013.01); *B01F 3/0446* (2013.01); *B01F 3/0861* (2013.01); *B01F 5/0415* (2013.01); *B01F 5/0416* (2013.01); *B01F 5/0426* (2013.01); *B01F 5/104* (2013.01); *B01F 5/106* (2013.01); *B01F 2215/0081* (2013.01)

(58) Field of Classification Search

CPC ..... B28C 5/1246; E21B 21/062
USPC ..... 366/9, 10, 11, 16, 348, 136, 137, 163.2
See application file for complete search history.

(56) References Cited

U.S. PATENT DOCUMENTS

| | | | | |
|---|---|---|---|---|
| 2,017,867 | A * | 10/1935 | Nantz | 366/163.2 |
| 3,637,021 | A | 1/1972 | Hutchison et al. | |
| 4,683,944 | A * | 8/1987 | Curlett | 166/65.1 |
| 5,249,635 | A * | 10/1993 | King et al. | 175/48 |
| 5,489,153 | A | 2/1996 | Berner et al. | |

(Continued)

FOREIGN PATENT DOCUMENTS

| | | | |
|---|---|---|---|
| AU | 2007286668 | A1 | 2/2008 |
| EP | 0282061 | A2 | 9/1988 |

(Continued)

OTHER PUBLICATIONS

PCT International Search Report issued in PCT Application No. PCT/US2007/076531 dated Jan. 28, 2008 (3 pages).

(Continued)

*Primary Examiner* — Tony G Soohoo
*Assistant Examiner* — Anshu Bhatia
(74) *Attorney, Agent, or Firm* — David Joshua Smith

(57) ABSTRACT

A system for mixing drilling fluids that includes a fluid supply tank for supplying an unmixed drilling fluid, a mixing reactor fluidly connected to the fluid supply tank, the mixing reactor including an intake and an outlet; a mixing chamber disposed between the intake and the outlet, an inlet for injecting a compressible driving fluid into the mixing chamber and an inlet for injecting an aerating gas into the mixing chamber is disclosed.

6 Claims, 6 Drawing Sheets

(56) References Cited

U.S. PATENT DOCUMENTS

| | | | | |
|---|---|---|---|---|
| 5,516,423 | A * | 5/1996 | Conoby | B01J 19/0006 366/134 |
| 5,520,460 | A | 5/1996 | Lantz | |
| 6,039,470 | A | 3/2000 | Conwell | |
| 6,254,267 | B1 | 7/2001 | Arnaud | |
| 6,562,763 | B2 | 5/2003 | Adams et al. | |
| 6,662,549 | B2 | 12/2003 | Burns et al. | |
| 6,662,550 | B2 | 12/2003 | Eidelman et al. | |
| 6,662,551 | B2 | 12/2003 | Majima et al. | |
| 6,932,169 | B2 | 8/2005 | Wylie et al. | |
| 2001/0011688 | A1 | 8/2001 | Whitlatch et al. | |
| 2002/0085447 | A1 * | 7/2002 | Snyder | B01F 15/00227 366/136 |
| 2004/0100858 | A1 * | 5/2004 | Rondeau et al. | 366/19 |
| 2005/0183574 | A1 | 8/2005 | Burnett et al. | |
| 2007/0043472 | A1 * | 2/2007 | Anderson | B01F 13/1055 700/265 |

FOREIGN PATENT DOCUMENTS

| | | | |
|---|---|---|---|
| GB | 1250186 | A | 10/1971 |
| WO | 2004033920 | A1 | 4/2004 |

OTHER PUBLICATIONS

PCT Written Opinion issued in PCT Application No. PCT/US2007/076531 dated Jan. 28, 2008 (3 pages).

Office Action issued in related Australian Application No. 2007286668 dated Jan. 28, 2010. (2 pages).

Office Action issued in related Eurasian Patent Application No. 200970213 dated Mar. 19, 2010. (3 pages).

Office Action issued in Canadian Application No. 2,661,016 dated May 26, 2010 (3 pages).

Official Action issued in related Eurasian Patent application No. 200970213; Dated Jan. 25, 2011 (4 pages).

Office Action issued in related Argentine Patent Application AR062502 A1; Dated Jan. 17, 2012 (2 pages).

Extended European Search Report issued in corresponding European Application No. 07841223.6 dated Feb. 27, 2013 (8 pages).

Office Action issued in corresponding European Application No. 07841223.6; Dated Feb. 12, 2014 (3 pages).

* cited by examiner

PROCESS FOR MIXING WELLBORE FLUIDS

CROSS-REFERENCE TO RELATED APPLICATIONS

This is a divisional application, and claims benefit under 35 U.S.C. §121 of U.S. patent application Ser. No. 11/842,506, filed Aug. 21, 2007, which, pursuant to 35 U.S.C. §119(e), claims priority to U.S. Patent Application Ser. No. 60/823,346 filed on Aug. 23, 2007, which is herein incorporated by reference in its entirety.

BACKGROUND OF INVENTION

Field of the Invention

Embodiments disclosed herein relate generally to wellbore fluids. In particular, embodiments disclosed herein relate generally to processes for mixing wellbore fluids.

Background Art

When drilling or completing wells in earth formations, various fluids typically are used in the well for a variety of reasons. Common uses for well fluids include: lubrication and cooling of drill bit cutting surfaces while drilling generally or drilling-in (i.e., drilling in a targeted petroliferous formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, transmitting hydraulic horsepower to the drill bit, fluid used for emplacing a packer, abandoning the well or preparing the well for abandonment, and otherwise treating the well or the formation.

In general, drilling fluids should be pumpable under pressure down through strings of drilling pipe, then through and around the drilling bit head deep in the earth, and then returned back to the earth surface through an annulus between the outside of the drill stem and the hole wall or casing. Beyond providing drilling lubrication and efficiency, and retarding wear, drilling fluids should suspend and transport solid particles to the surface for screening out and disposal. In addition, the fluids should be capable of suspending additive weighting agents (to increase specific gravity of the mud), generally finely ground barites (barium sulfate ore), and transport clay and other substances capable of adhering to and coating the borehole surface.

Drilling fluids are generally characterized as thixotropic fluid systems. That is, they exhibit low viscosity when sheared, such as when in circulation (as occurs during pumping or contact with the moving drilling bit). However, when the shearing action is halted, the fluid should be capable of suspending the solids it contains to prevent gravity separation. In addition, when the drilling fluid is under shear conditions and a free-flowing near-liquid, it must retain a sufficiently high enough viscosity to carry all unwanted particulate matter from the bottom of the well bore to the surface. The drilling fluid formulation should also allow the cuttings and other unwanted particulate material to be removed or otherwise settle out from the liquid fraction.

There is an increasing need for drilling fluids having the rheological profiles that enable these wells to be drilled more easily. Drilling fluids having tailored rheological properties ensure that cuttings are removed from the wellbore as efficiently and effectively as possible to avoid the formation of cuttings beds in the well which may cause the drill string to become stuck, among other issues. There is also the need, from a drilling fluid hydraulics perspective (equivalent circulating density), to reduce the pressures required to circulate the fluid, this helps to avoid exposing the formation to excessive forces that may fracture the formation causing the fluid, and possibly the well, to be lost. In addition, an enhanced profile is necessary to prevent settlement or sag of the weighting agent in the fluid. If this occurs, it can lead to an uneven density profile within the circulating fluid system that may result in well control (gas/fluid influx) and wellbore stability problems (caving/fractures).

To obtain the fluid characteristics required to meet these challenges, the fluid must be easy to pump, so it requires the minimum amount of pressure to force it through restrictions in the circulating fluid system, such as bit nozzles or down-hole tools. Or in other words, the fluid must have the lowest possible viscosity under high shear conditions. Conversely, in zones of the well where the area for fluid flow is large and the velocity of the fluid is slow or where there are low shear conditions, the viscosity of the fluid needs to be as high as possible in order to suspend and transport the drilled cuttings. This also applies to the periods when the fluid is left static in the hole, where both cuttings and weighting materials need to be kept suspended to prevent settlement. However, it should also be noted that the viscosity of the fluid should not continue to increase under static conditions to unacceptable levels. If this occurs, it can lead to excessive pressures when the fluid is circulated again that can fracture the formation, or alternatively it can lead to lost time if the force required to regain a fully circulating fluid system is beyond the limits of the pumps.

Depending on the particular well to be drilled, a drilling operator typically selects between a water-based drilling fluid and an oil-based or synthetic drilling fluid. Each of the water-based fluid and oil-based fluid typically include a variety of additives to create a fluid having the rheological profile necessary for a particular drilling application. For example, a variety of compounds are typically added to water- or brine-based well fluids, including viscosifiers, corrosion inhibitors, lubricants, pH control additives, surfactants, solvents, thinners, thinning agents, and/or weighting agents, among other additives. Some typical water- or brine-based well fluid viscosifying additives include clays, synthetic polymers, natural polymers and derivatives thereof such as xanthan gum and hydroxyethyl cellulose (HEC). Similarly, a variety of compounds are also typically added to a oil-based fluid including weighting agents, wetting agents, organophilic clays, viscosifiers, fluid loss control agents, surfactants, dispersants, interfacial tension reducers, pH buffers, mutual solvents, thinners, thinning agents and cleaning agents.

While the preparation of drilling fluids can have a direct effect upon their performance in a well, and thus profits realized from that well, methods of drilling fluid preparation have changed little over the past several years. Typically, the mixing method still employs manual labor to empty sacks of drilling fluid components into a hopper to make an initial drilling fluid composition. However, because of agglomerates formed as a result of inadequate high shear mixing during the initial production of the drilling fluid composition, screen shakers used in a recycling process to remove drill cuttings from a fluid for recirculation into the well also filter out as much as thirty percent of the initial drilling fluid components prior to the fluid's reuse. In addition to the cost inefficiency when a drilling fluid is inadequately mixed, and thus components are aggregated and filtered from the fluid, the fluids also tend to fail in some respect in their performance downhole. Inadequate performance may result from the observations that the currently available mixing techniques hinder the ability to reach the fluids rheological capabilities. For example, it is frequently observed that drilling fluids only reach their absolute yield points after downhole circulation.

Furthermore, for drilling fluids that incorporate a polymer that is supplied in a dry form, the adequacy of the initial mixing is further compounded by the hydration of those polymers. When polymer particles are mixed with a liquid such as water, the outer portion of the polymer particles wet instantaneously on contact with the liquid, while the center remains unwetted. Also effecting the hydration is a viscous shell that is formed by the outer wetted portion of the polymer, further restricting the wetting of the inner portion of the polymer. These partially wetted or unwetted particles are known in the art as "fisheyes." While fisheyes can be processed with mechanical mixers to a certain extent to form a homogenously wetted mixture, the mechanical mixing not only requires energy, but also degrades the molecular bonds of the polymer and reduces the efficacy of the polymer. Thus, while many research efforts in the drilling fluid technology area focus on modifying drilling fluid formulations to obtain and optimize rheological properties and performance characteristics, the full performance capabilities of many of these fluid are not always met due to inadequate mixing techniques or molecular degradation due to mechanical mixing.

Accordingly, there exists a need for improved techniques which enable efficient and effective mixing of drilling fluids.

SUMMARY OF INVENTION

In one aspect, embodiments disclosed herein relate to a method for mixing a drilling fluid formulation that includes establishing a flow path for a base fluid, adding drilling fluid additives to the base fluid to create a mixture, aerating the mixture of base fluid and drilling fluid additives, and injecting a compressible driving fluid into the mixture of base fluid and drilling fluid additives to form a mixed drilling fluid.

In another aspect, embodiments disclosed herein relate to a system for mixing drilling fluids that includes a fluid supply tank for supplying an unmixed drilling fluid; and a mixing reactor fluidly connected to the fluid supply tank, wherein the mixing reactor includes an intake and an outlet; a mixing chamber disposed between the inlet and outlet; an inlet for injecting a compressible driving fluid into the mixing chamber; and an inlet for injecting an aerating gas into the mixing chamber, and wherein as the unmixed drilling fluid flows into the mixing reactor, the compressible driving fluid and aerating gas are injected into the unmixed drilling fluid to form the mixed drilling fluid.

Other aspects and advantages of the disclosed embodiments will be apparent from the following description and the appended claims.

DETAILED DESCRIPTION

In one aspect, embodiments disclosed herein relate to methods and systems for mixing drilling fluid components to produce drilling fluids that are substantially homogenously mixed.

Figure 1:
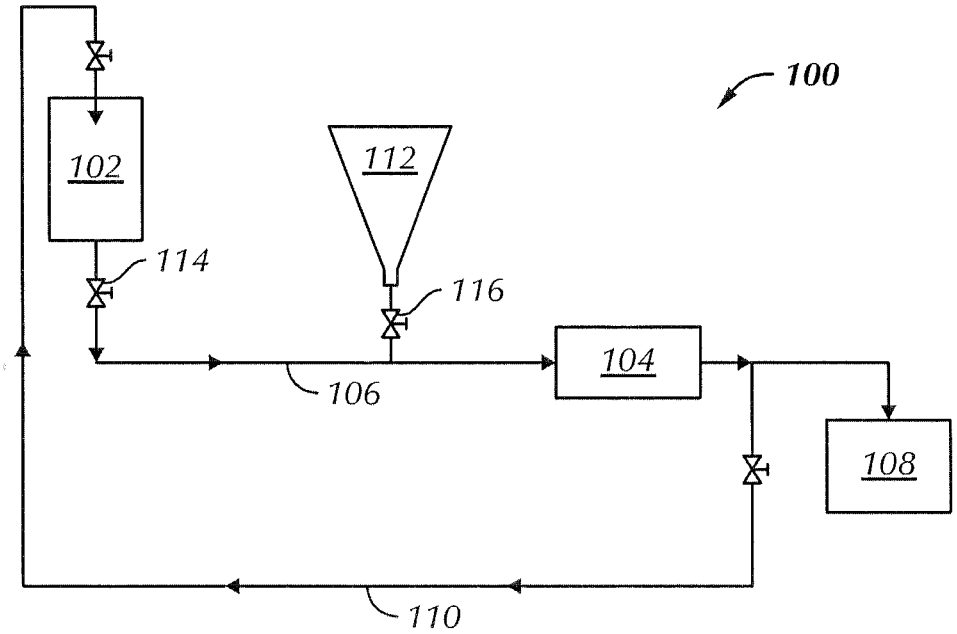
FIG. 1 shows a system according to one embodiment of the present disclosure.

Referring to FIG. 1, a system 100 for mixing drilling fluids in accordance with an embodiment of the present disclosure is shown. In this embodiment, fluid supply tank (i.e., mud pit in various embodiments) 102 is connected to mixing reactor 104 via fluid line 106 such that an unmixed drilling fluid flows from fluid supply tank 102 into mixing reactor 104. A mixed drilling fluid exits mixing reactor 104 and may be either collected in receiving tank 108 or if additional mixing is desired, the mixed fluid may be returned via recycling fluid line 110 through fluid supply tank 102 to fluid line 106 for a subsequent pass through mixing reactor 104. Alternatively, recycled fluid line 110 may be directly connected to fluid line 106, and the fluid need not be passed through fluid supply tank 102. A hopper 112 is shown connected to fluid line 106 between fluid supply tank 102 and mixing reactor 104. As the unmixed drilling fluid flows from fluid supply tank 102 to mixing reactor 104, drilling fluid additives, may flow from hopper 112 into the unmixed drilling fluid. However, one of skill in the art would recognize that in alternative embodiments, hopper 112 may be connected to fluid supply tank 102 so that additives may be poured directly into fluid supply tank 102, or in alternate embodiments, additives may be poured directly into fluid supply tank 102 without the use of hopper 112.

As a base fluid and drilling fluid additives are introduced into system 100, a fluid regulation valve 114 (and additive regulation valve 116, if a hopper is used) may control the flow of base fluid and drilling fluid additives, respectively, into fluid line 106 and thus mixing reactor 104.

Figure 2:
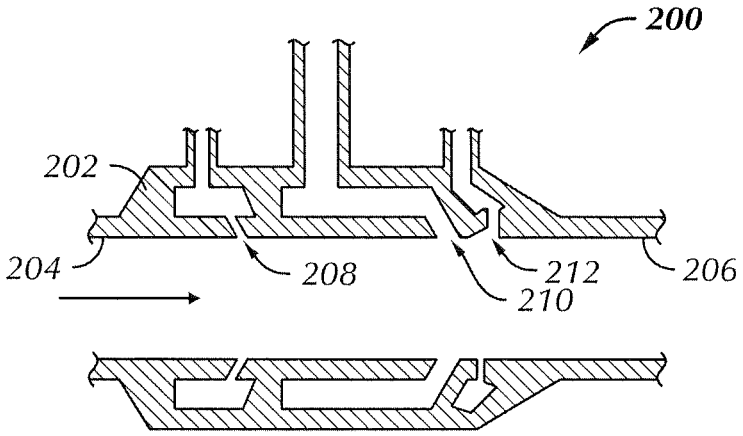
FIG. 2 shows a cross-section of a mixing reactor of a system according to one embodiment of the present disclosure.

Referring to FIG. 2, a mixing reactor 200 in accordance with one embodiment of the present disclosure is shown. Mixing reactor 200 includes a mixing chamber 202, defining a flow passage for the drilling fluid, and an intake 204 and an outlet 206 through which the drilling fluid, respectively, enters unmixed and exits mixed. After drilling fluid enters the mixing reactor 200 through intake 204, it flows into mixing chamber 202. Inlets 208 and 212 in the side wall of mixing chamber 202 provide a first and second aerating gas, respectively, to the flow path of unmixed drilling fluid. Inlet 210 in the side walls of mixing chamber 202 provides a compressible driving fluid to the unmixed drilling fluid. One of ordinary skill in the art would recognize that inlets 208,

210, and 212 may each individually include, for example, nozzle structures, ports, isolation valve and/or aperatures. In alternate embodiments, the mixing chamber 202 may have a single inlet for injecting an aerating gas and may be placed either upstream or downstream from the driving fluid inlet 210, or the aerating gas and the compressible driving fluid may be injected through the same inlet.

As the driving fluid enters the mixing chamber, it may undergo a reduction in pressure and increase in velocity (typically to supersonic levels). As the high velocity driving fluid condenses via expansion and the cooling influence of the drilling fluid, a pressure reduction in the mixing chamber may result. The rapid pressure reduction is in effect an implosion within the mixing zone. A volumetric collapse of the driving fluid may draw further unmixed drilling fluid through the intake and mixing chamber. The high velocity of the driving fluid may also affect momentum transfer to the drilling fluid and accelerate the drilling fluid flow at an increased velocity. Consequently, unmixed drilling fluid may be entrained from the intake to the mixing chamber on a continuous basis. During operation of the mixing reactor, the driving fluid may be injected into the drilling fluid on a continual basis or on an intermittent basis such as in a pulsed fashion.

As the velocity of the mixed driving fluid and drilling fluid becomes supersonic, it may form a shock wave. As the shockwave grows, a low density, low pressure, supersonic energy wave or shock zone may be formed in the mixing chamber across the bore diameter, thereby increasing energy transfer. High shear forces in the shock zone may homogeneously mix the gas and liquid to produce an aerated mix with fine bubble. The high shear forces in the shock zone may also form a substantially homogenously mixed drilling fluid.

The compressible driving fluid may include a substantially gaseous fluid capable of rapid pressure reduction upon exposure to the cooling influence of the drilling fluid. In some embodiments, the compressible driving fluid may include a gas or a gaseous mixture. In other embodiments, compressible driving fluid may have particles such as liquid droplets entrained therein. In a particular embodiment, the driving fluid may, for example, comprise a condensable vapor such as steam. One of ordinary skill in the art would recognize that when the drilling fluid contains water, steam may be a particularly appropriate form of driving fluid so there is no undesirable contamination of the drilling fluid upon contact with the steam. The driving fluid may also be a multi-phase fluid, such as a mixture of steam, air, and water droplets, e.g., where the air and water droplets may be in the form of a mist. Such a multi-phase fluid may also serve to increase the mass flow rate of the driving fluid and the density of the driving fluid to a density more similar to the density of the drilling fluid.

The compressible driving fluid injected into the unmixed drilling fluid may have a supply temperature proportional to its supply pressure. When the compressible driving fluid is injected into the unmixed drilling fluid it can have the effect as to increase the temperature of the drilling fluid. The degree of temperature increase may be dependent on the chosen flow rate of the compressible driving fluid. In one embodiment, the temperature of the driving fluid is a temperature of at least 50° C., providing a 30° C. temperature rise above the ambient condition of 20° C. In an alternate embodiment, a drilling fluid temperature rise of more than 50° C. above ambient temperature may be observed. The compressible driving fluid may also be pressurized prior to injection into the drilling fluid. In one embodiment, the compressible driving fluid may be subjected to a pressure ranging from about 3 to about 10 bar. The process of injecting the compressible driving fluid into a lower pressure environment may result in the compressible driving fluid pressure reaching equilibrium pressure to the local environment pressure.

During operation of the mixing reactor, the driving fluid may be injected into the drilling fluid on a continual basis or on an intermittent basis (e.g., in a pulsed fashion). The flow rates of the driving fluid and the drilling fluid may be selected according to the desired flow rate of working fluid discharging at the outlet. The required total drilling fluid flow rate will dictate the physical size of the mixing reactor and hence the flow. Each size of mixing reactor may have a proportional relationship between the flow rate of driving fluid to that of the induced drilling fluid inlet flow rate.

Figure 3:
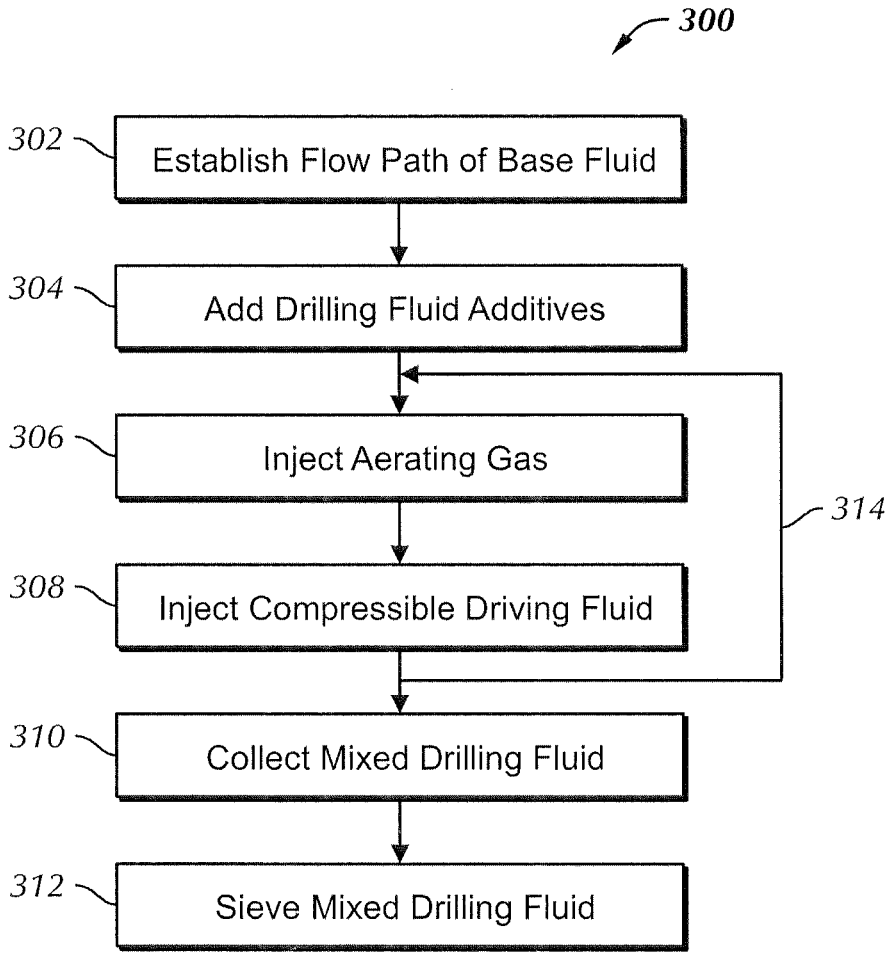
FIG. 3 shows a method according to one embodiment of the present disclosure.

Referring to FIG. 3, a method 300 for mixing drilling fluids according to one embodiment disclosed herein is shown. Method 300 includes establishing a flow path for a base fluid at step 302. Drilling fluid additives may be added to the base fluid (step 304) either prior to or after the establishment of the flow path for the base fluid. The non-homogenous mixture of base fluid and drilling fluid additives may be injected with an aerating gas (step 306) and a compressible driving fluid (step 308) to form a substantially homogenously mixed drilling fluid. According to various embodiments, aeration (step 306) may occur prior to, post, or both prior to and post injection of the compressible driving fluid (step 308). The mixed drilling fluid may then be collected (step 310) and/or sieved (step 312) or may be recirculated (step 314) through the mixing reactor to receive a second pass (or third, etc) pass at aeration and injection of the compressible driving fluid.

Figure 4:
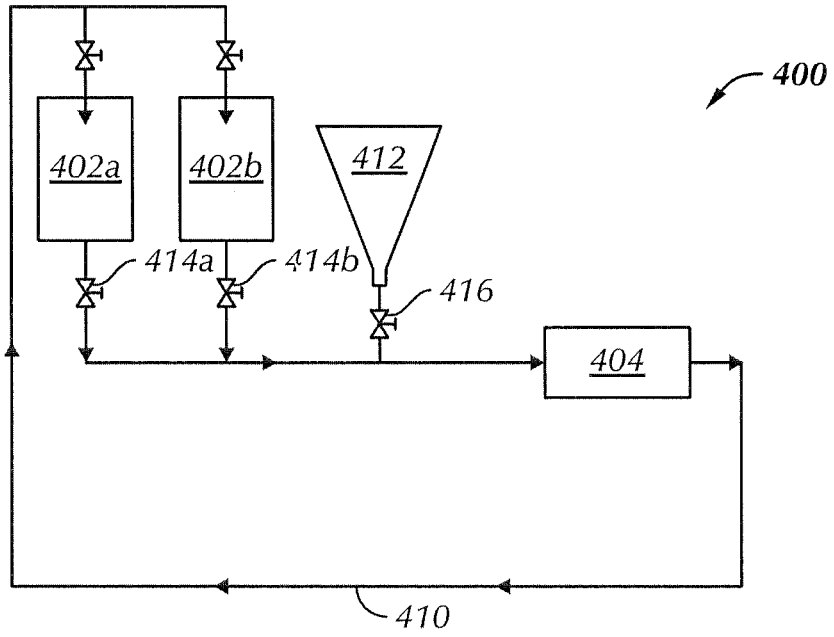
FIG. 4 shows a system according to one embodiment of the present disclosure.

While FIG. 3 refers to one embodiment of a system for mixing drilling fluids, one of ordinary skill in the art will appreciate that variations in the system may be made without departing from the scope of the present disclosure. Referring to FIG. 4, a system 400 for mixing drilling fluids in accordance with an embodiment of the present disclosure is shown. In this embodiment, fluid supply tanks (i.e., mud pit in various embodiments) 402*a* and 402*b* are connected to mixing reactor 404 via fluid line 406 such that an unmixed drilling fluid flows from fluid supply tank 402*a* and/or 402*b* into mixing reactor 404. A mixed drilling fluid exits mixing reactor 404 and may be either returned via recycling fluid line 410 through either fluid supply tank 402*a* to fluid line 406 for a subsequent pass through mixing reactor 404 or through parallel fluid supply tank 402*b*. A hopper 412 is shown connected to fluid line 406 between fluid supply tank 402*a/b* and mixing reactor 404. As the unmixed drilling fluid flows from fluid supply tank 402 to mixing reactor 404, drilling fluid additives, may flow from hopper 412 into the unmixed drilling fluid. However, one of skill in the art would recognize that in alternative embodiments, hopper 412 may be connected to fluid supply tank 402 so that additives may be poured directly into fluid supply tank 402*a* or 402*b*, or in alternate embodiments, additives may be poured directly into fluid supply tank 402*a* or 404*b* without the use of hopper 412.

As a base fluid and drilling fluid additives are introduced into system 400, fluid regulation valves 414*a* and/or 414*b* (and additive regulation valve 116, if a hopper is used) may control the flow of base fluid and drilling fluid additives, respectively, into fluid line 406 and thus mixing reactor 404.

Figure 5:
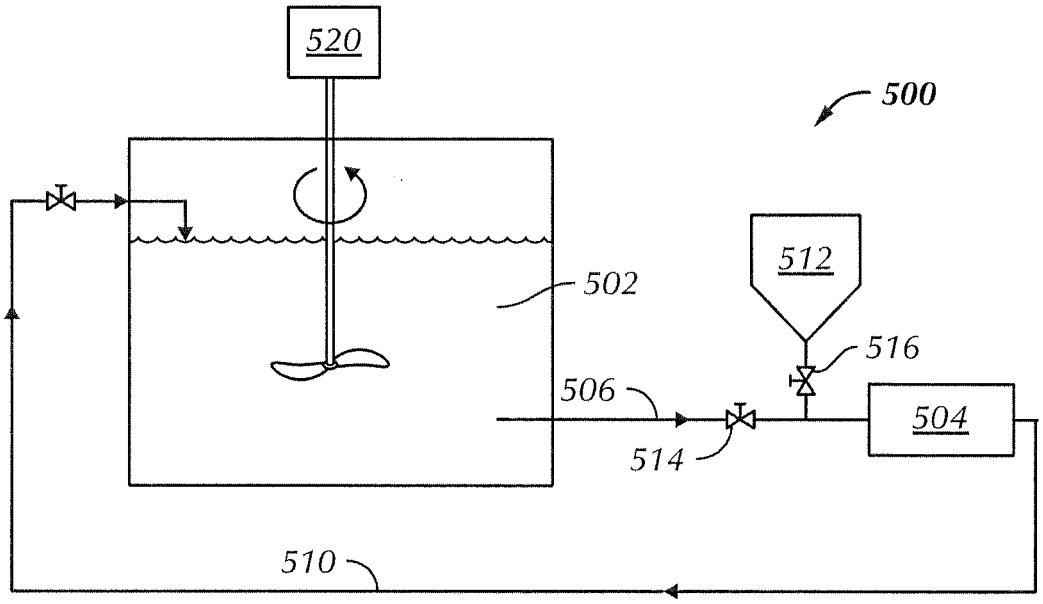
FIG. 5 shows a system according to one embodiment of the present disclosure.

Referring to FIG. 5, a system 500 for mixing drilling fluids in accordance with another embodiment of the present disclosure is shown. In this embodiment, fluid supply tank (i.e., mud pit in various embodiments) 502, which may optionally include a tank agitator 520, is connected to mixing reactor 504 via fluid line 506 such that an unmixed drilling fluid flows from fluid supply tank 502 into mixing reactor 504. A mixed drilling fluid exits mixing reactor 504 may be returned via recycling fluid line 510 to fluid supply tank 502 (or to any other tank) or may flow through fluid supply tank 502 to fluid line 506 for a subsequent pass through mixing reactor 504. A hopper 512 is shown connected to fluid line 506 between fluid supply tank 502 and mixing reactor 504. As the unmixed drilling fluid flows from fluid supply tank 502 to mixing reactor 504, drilling fluid additives, may flow from hopper 512 into the unmixed drilling fluid. However, one of skill in the art would recognize that in alternative embodiments, hopper 512 may be connected to fluid supply tank 502 so that additives may be poured directly into fluid supply tank 502, or in yet other alternate embodiments, additives may be poured directly into fluid supply tank 502 without the use of hopper 512.

As a base fluid and drilling fluid additives are introduced into system 500, a fluid regulation valve 514 (and additive regulation valve 516, if a hopper is used) may control the flow of base fluid and drilling fluid additives, respectively, into fluid line 506 and thus mixing reactor 504.

Figure 6:
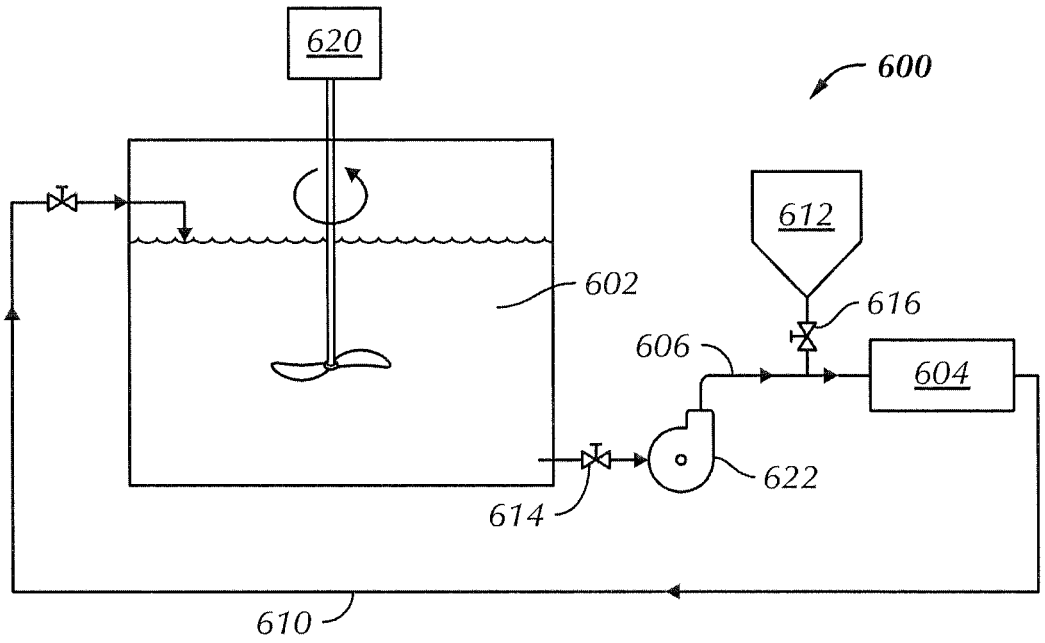
FIG. 6 shows a system according to one embodiment of the present disclosure.

Referring to FIG. 6, a system 600 for mixing drilling fluids in accordance with yet another embodiment of the present disclosure is shown. In this embodiment, fluid supply tank (i.e., mud pit in various embodiments) 602, which may optionally include a tank agitator 620, is connected to mixing reactor 604 via fluid line 606 such that an unmixed drilling fluid flows from fluid supply tank 602 into mixing reactor 604. The unmixed drilling fluid may be pushed into the mixing reactor 604 by pump 622 on flow line 606. A mixed drilling fluid exits mixing reactor 604 and may be returned via recycling fluid line 610 to fluid supply tank 602 (or to any other tank) or may flow through fluid supply tank 602 to fluid line 606 for a subsequent pass through mixing reactor 604. A hopper 612 is shown connected to fluid line 606 between pump 622 and mixing reactor 604. As the unmixed drilling fluid is pumped from fluid supply tank 602 to mixing reactor 604, drilling fluid additives may flow from hopper 612 into the unmixed drilling fluid. However, one of skill in the art would recognize that in alternative embodiments, hopper 612 may be connected to fluid supply tank 602 so that additives may be poured directly into fluid supply tank 602, or in yet other alternate embodiments, additives may be poured directly into fluid supply tank 602 without the use of hopper 612.

As a base fluid and drilling fluid additives are introduced into system 600, a fluid regulation valve 614 (and additive regulation valve 616, if a hopper is used) may control the flow of base fluid and drilling fluid additives, respectively, into fluid line 606 and thus mixing reactor 604.

Figure 7:
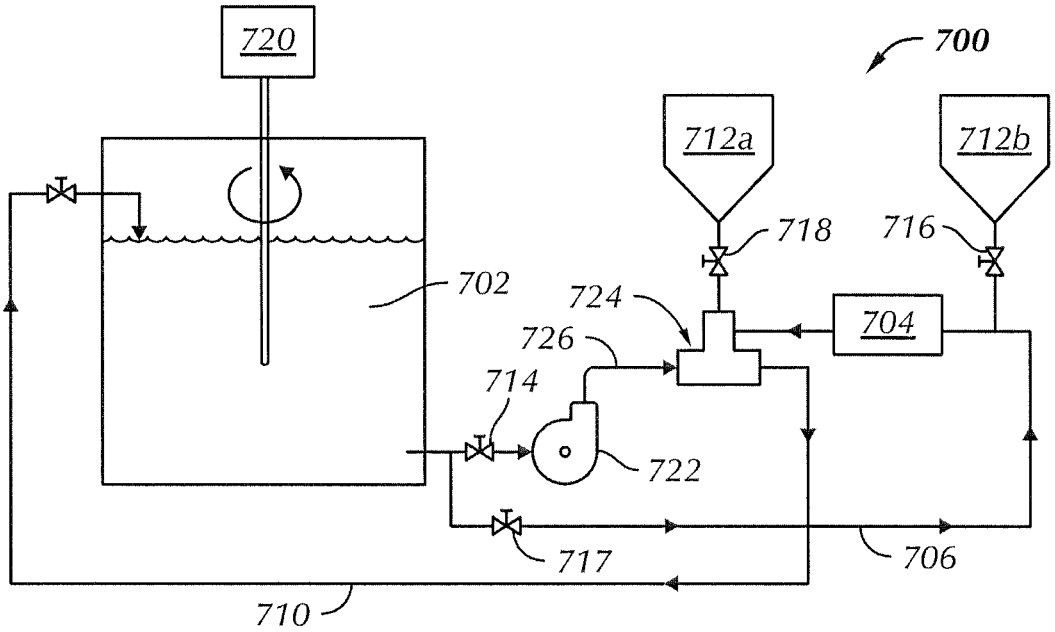
FIG. 7 shows a system according to one embodiment of the present disclosure.

Referring to FIG. 7, a system 700 for mixing drilling fluids in accordance with yet another embodiment of the present disclosure is shown. In this embodiment, fluid supply tank (i.e., mud pit in various embodiments) 702, which may optionally include a tank agitator 720, is connected to mixing reactor 704 via fluid line 706 such that an unmixed drilling fluid flows from fluid supply tank 702 into mixing reactor 704. In operation, an unmixed drilling fluid may be pumped from fluid supply tank 702 by pump 722 though fluid line 726. Unmixed drilling fluid may be pumped through eductor 724, which is connected to hopper 712*a* and to the outlet (not shown) of mixing reactor 704, and returned to fluid supply tank 702. As drilling fluid is pumped through eductor 724, a negative pressure draws unmixed drilling fluid from fluid supply tank 702 through mixing reactor 704 via fluid supply line 706. Once mixed, drilling fluid may be returned to fluid supply tank 702 (or any other tank) via recycling line 710. Drilling fluid additives may be added to the system at hopper 712*a* and/or 712*b*.

As a base fluid and drilling fluid additives are introduced into system 700, a fluid regulation valve 714 may control the flow of base fluid into fluid line 726 and through eductor 724, and fluid regulation valve 717 may control the flow of base fluid into fluid line 706 and thus through mixing reactor 704. The entry of drilling fluid additives through hopper 712*a* may be controlled by additive regulation 718, and similarly, additive regulation valve 716 may control the entry of drilling fluid additives through hopper 112*b*.

One of ordinary skill in the art would recognize that the system 700 shown in FIG. 7 may be a modification of a conventional mud mixing hopper system in which additives are added via hopper 712*a* to a base fluid that flows through eductor 724 and is returned to fluid supply tank 702. By connecting the outlet of mixing reactor 704 to outlet of eductor 724, the negative pressure generated in pumping fluid through the eductor may be used to draw drilling fluid through mixing reactor 704 and allow for the substantially homogenous mixture of a base fluid with additives supplied by hopper 712*b*. Further, one of ordinary skill in the art would also appreciate that other modifications to conventional mud mixing hopper systems may be performed without departing from the scope of the present disclosure.

Figure 8:
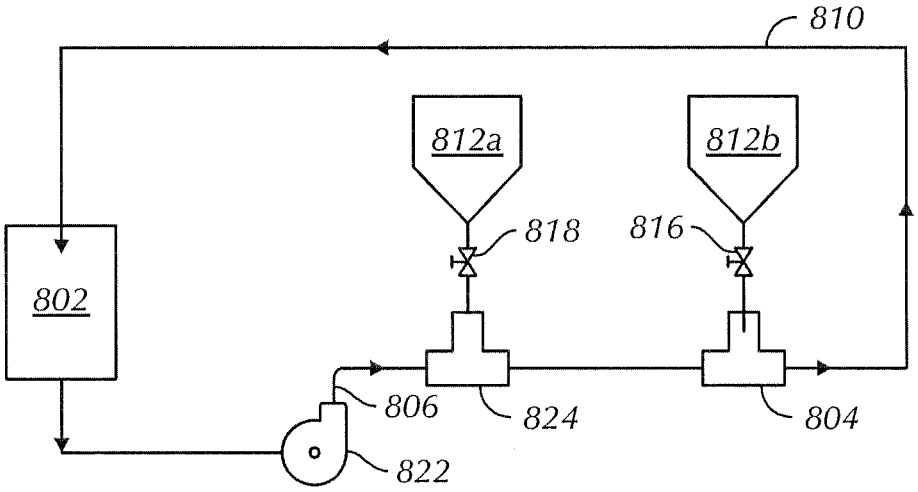
FIG. 8 shows a system according to one embodiment of the present disclosure.

Referring to FIG. 8, a system 800 for mixing drilling fluids in accordance with yet another embodiment of the present disclosure is shown. In this embodiment, fluid supply tank (i.e., mud pit in various embodiments) 802, which may optionally include a tank agitator (not shown), is connected to mixing reactor 804 via fluid line 806 such that an unmixed drilling fluid flows from fluid supply tank 802 into mixing reactor 804. In operation, an unmixed drilling fluid may be pumped from fluid supply tank 802 by pump 822 though fluid supply line 806. As fluid from fluid supply line 806 is pumped through eductor 824, a negative pressure draws additives from hopper 812*a* into the fluid. The unmixed drilling fluid then flows through mixing reactor 804 and is mixed. Once mixed, drilling fluid may be returned to fluid supply tank 802 (or any other tank) via recycling line 810. One of ordinary skill in the art would appreciate that multiple hoppers may be used to add drilling fluid additives may be added to the system, such as at hopper 812*a* and/or 812*b*. The entry of drilling fluid additives through hopper 812*a* may be controlled by additive regulation 818, and similarly, additive regulation valve 816 may control the entry of drilling fluid additives through hopper 812*b*.

One of ordinary skill in the art would recognize that the system 800 shown in FIG. 8 may be a modification of a conventional mud mixing hopper system in which additives are added via hopper 812*a* to a base fluid that flows through eductor 824 and is returned to fluid supply tank 802. Further, one of ordinary skill in the art would also appreciate that other modifications to conventional mud mixing hopper systems may be performed without departing from the scope of the present disclosure.

Figure 9A:
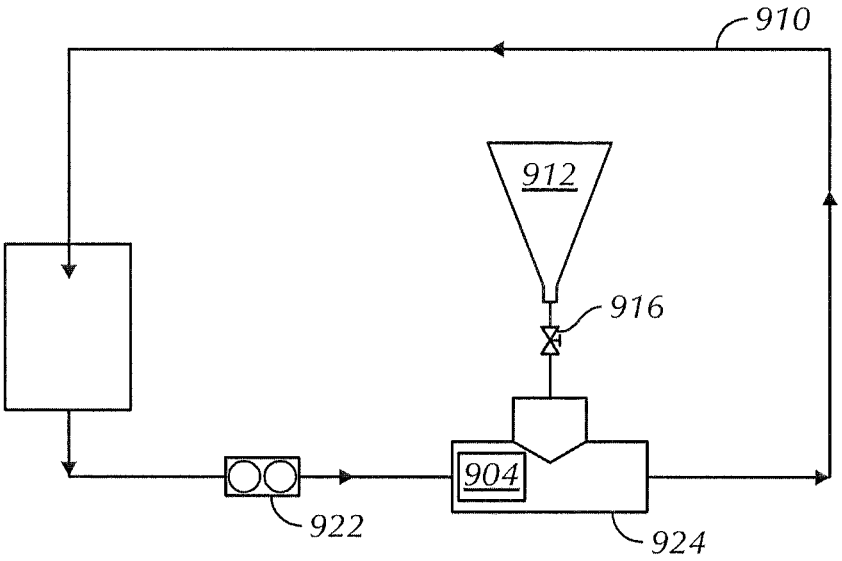
FIG. 9A shows a system according to one embodiment of the present disclosure.
Figure 9B:
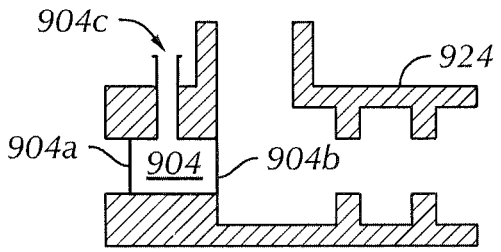
FIG. 9B shows a partial view of the system shown in FIG. 9A.

Referring to FIGS. 9A-B, a system 900 for mixing drilling fluids in accordance with yet another embodiment of the present disclosure is shown. In this embodiment, fluid supply tank (i.e., mud pit in various embodiments) 902, which may optionally include a tank agitator (not shown), is connected to mixing reactor 904 via fluid line 906 such that an unmixed drilling fluid flows from fluid supply tank 902 into mixing reactor 904, which is located such that it forms the inlet or nozzle of eductor 924. In operation, an unmixed drilling fluid may be pumped from fluid supply tank 902 by pump 922 though fluid supply line 906. As fluid from fluid supply line 906 is pumped through eductor 924 and thus mixing reactor 904, a negative pressure draws additives from hopper 912 into the fluid. Additive regulation valve 916 may be used to control the entry of additives through hopper 912 into eductor 924. Unmixed drilling fluid flows through intake 904*a* and outlet 904*b* of mixing reactor 904 as gas(es), such as steam are injected 904*c* into mixing reactor 904. As gas(es) and/or fluid(s) are injected into the mixing reactor 904, they may undergo a reduction in pressure and increase in velocity (typically to supersonic levels), which as described above, may draw further unmixed drilling fluid into and through the mixing reactor, as drilling fluid additives are drawn into and mixed with the fluid in eductor 924. Once mixed, drilling fluid exits eductor 924 and may be returned to fluid supply tank 802 (or any other tank) via recycling line 910.

Figure 10:
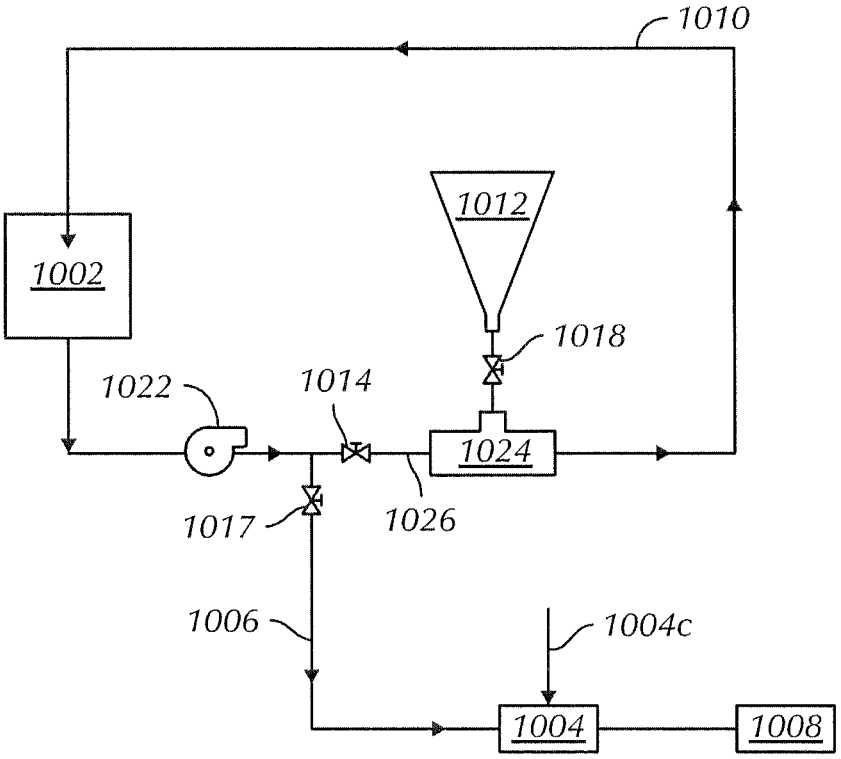
FIG. 10 shows a system according to one embodiment of the present disclosure.

Referring to FIG. 10, a system 1000 for mixing drilling fluids in accordance with yet another embodiment of the present disclosure is shown. In this embodiment, unmixed drilling fluid in fluid supply tank (i.e., mud pit in various embodiments) 1002, which may optionally include a tank agitator (not shown), is connected to mixing reactor 1004 through fluid supply line 1006. In operation, unmixed drilling fluid may be pumped from fluid supply tank 1002 by pump 1022 though fluid line 1026. As fluid from fluid supply line 1006 is pumped through eductor 1024, a negative pressure draws additives (such as additives entrained in fluid) from hopper 1012 into the fluid, which may be recycled back into fluid supply tank 1002 via recycling line 1010. Fluid from fluid supply tank 1002 (which may contain additives therein) may alternatively be pumped through fluid supply line 1006 to mixing reactor 1004 where steam (or other fluids) may be injected 1004*c* therein to form a homogenously mixed drilling fluid. A mixed drilling fluid exits mixing reactor 1004 and may be either collected in receiving tank 1008 or if additional mixing is desired, the mixed fluid may be returned (not shown) through fluid supply tank 1002.

As a base fluid and drilling fluid additives are introduced into system 1000, a fluid regulation valve 1014 may control the flow of base fluid into fluid line 1026 and through eductor 1024, and fluid regulation valve 1017 may control the flow of base fluid into fluid line 1006 and thus through mixing reactor 1004. Further, the entry of drilling fluid additives through hopper 1012 may be controlled by additive regulation 1018. One of ordinary skill in the art would recognize that the system 1000 shown in FIG. 10 may be a modification of a conventional mud mixing hopper system in which additives are added via hopper 1012 to a base fluid that flows through eductor 1024 and is returned to fluid supply tank 1002.

Further, one of ordinary skill in the art would appreciate that additional components such as sensors, gauges, etc that may be used to measure, inter alia, pressures, temperatures, densities, flow rates, and flow levels may be included in any of the systems of the present disclosure.

The drilling fluids that may be mixed according to the embodiments disclosed herein may include water-based fluids as well as oil-based fluids. If the embodiments disclosed herein are used to mix oil-based fluids, it is also within the scope of the embodiments of the present disclosure that the disclosed method and system may also be used to form emulsions.

Water-based wellbore fluids may include an aqueous base fluid. The aqueous fluid may include at least one of fresh water, sea water, brine, mixtures of water and water-soluble organic compounds and mixtures thereof. For example, the aqueous fluid may be formulated with mixtures of desired salts in fresh water. Such salts may include, but are not limited to alkali metal chlorides, hydroxides, or carboxylates, for example. In various embodiments of the drilling fluid disclosed herein, the brine may include seawater, aqueous solutions wherein the salt concentration is less than that of sea water, or aqueous solutions wherein the salt concentration is greater than that of sea water. Salts that may be found in seawater include, but are not limited to, sodium, calcium, sulfur, aluminum, magnesium, potassium, strontium, silicon, lithium, and phosphorus salts of chlorides, bromides, carbonates, iodides, chlorates, bromates, formates, nitrates, oxides, and fluorides. Salts that may be incorporated in a given brine include any one or more of those present in natural seawater or any other organic or inorganic dissolved salts. Additionally, brines that may be used in the drilling fluids disclosed herein may be natural or synthetic, with synthetic brines tending to be much simpler in constitution. In one embodiment, the density of the drilling fluid may be controlled by increasing the salt concentration in the brine (up to saturation). In a particular embodiment, a brine may include halide or carboxylate salts of mono- or divalent cations of metals, such as cesium, potassium, calcium, zinc, and/or sodium. One of ordinary skill would appreciate that the above salts may be present in the base fluid, or alternatively, may be added according to the method disclosed herein.

Oil-based fluids may include an invert emulsion having an oleaginous continuous phase and a non-oleaginous discontinuous phase. The oleaginous fluid may be a liquid and more preferably may be a natural or synthetic oil and more preferably the oleaginous fluid is selected from the group including diesel oil, mineral oil, a synthetic oil, (e.g., hydrogenated and unhydrogenated olefins including polyalpha olefins, linear and branch olefins and the like, polydiorganosiloxanes, siloxanes, or organosiloxanes, esters of fatty acids, specifically straight chain, branched and cyclical alkyl ethers of fatty acids, mixtures thereof and similar compounds known to one of skill in the art), and mixtures thereof. The concentration of the oleaginous fluid should be sufficient so that an invert emulsion forms and may be less than about 99% by volume of the invert emulsion. In one embodiment the amount of oleaginous fluid is from about 30% to about 95% by volume, and more preferably about 40% to about 90% by volume of the invert emulsion fluid. The oleaginous fluid, in one embodiment, may include at least 5% by volume of a material selected from the group including esters, ethers, acetals, dialkylcarbonates, hydrocarbons, and combinations thereof.

The non-oleaginous fluid used in the formulation of the invert emulsion fluid disclosed herein is a liquid and may be an aqueous liquid. In one embodiment, the non-oleaginous liquid may be selected from the group including sea water, a brine containing organic and/or inorganic dissolved salts, liquids containing water-miscible organic compounds and combinations thereof. The amount of the non-oleaginous fluid is typically less than the theoretical limit needed for forming an invert emulsion. Thus in one embodiment, the amount of non-oleaginous fluid may be less that about 70% by volume and preferably from about 1% to about 70% by volume. In another embodiment, the non-oleaginous fluid may preferably be from about 5% to about 60% by volume of the invert emulsion fluid. The fluid phase may include either an aqueous fluid, an oleaginous fluid, or mixtures thereof.

Drilling fluid additives that may be added to the base fluids described above include a variety of compounds such as, for example, viscosifiers, corrosion inhibitors, lubricants, pH control additives, surfactants, solvents, thinners, thinning agents, and/or weighting agents, wetting agents, fluid loss control agents, dispersants, interfacial tension reducers, pH buffers, mutual solvents, and cleaning agents, among other additives. Some typical viscosifying additives include clays, organophilic clays, synthetic polymers, natural polymers and derivatives thereof such as xanthan gum and hydroxyethyl cellulose.

EXAMPLES

The following examples were used to test the effectiveness of the methods and systems disclosed herein in mixing drilling fluids.

Sample 1: Gel Slurry

A gel slurry was formed by adding bentonite (5.7 kg) to a fresh water flow (92.8 kg) and aerating/injecting steam into the flow using a mixing reactor system as described above. Steam was injected at a rate of 3.2-0.3 kg/min with a pressure of 5 bar for 30 seconds, thus injecting 1.5 kg of steam and forming a 100 kg gel slurry sample. The mixed slurry was visually examined for fisheyes, none of which were found in the sample.

Sample 2: 1 lb/bbl POLYPAC® UL, 0.333 lb/bbl DUO-VIS® in Gel Slurry

A flow of 100 kg of Sample 1 gel slurry was established in the mixing reactor system described above. POLYPAC® UL (polyanionic cellulose) (0.286 kg) and DUO-VIS® (xanthan gum) (0.095 kg), both of which are available from M-I LLC, Houston, Tex., were added to the gel flow and the sample was formed by aerating/injecting steam into the flow. Steam was injected at a rate of 3.2-0.3 kg/min with a pressure of 5 bar for 30 seconds, thus injecting 1.5 kg of steam. After the first pass, the product was transferred back to the feeding tank for a second, and third, pass. After each pass, a sample of the product was visually examined for fisheyes, none of which were found in the samples.

Sample 3: 2 lb/bbl POLYPAC® UL, 0.667 lb/bbl DUO-VIS® in Gel Slurry

A flow of 100 kg of Sample 1 gel slurry was established in the mixing reactor system described above. POLYPAC® UL (polyanionic cellulose) (0.572 kg) and DUO-VIS® (xanthan gum) (0.191 kg) were added to the gel flow and the sample was formed by aerating/injecting steam into the flow. Steam was injected at a rate of 3.2-0.3 kg/min with a pressure of 5 bar for 30 seconds, thus injecting 1.5 kg of steam. After the first pass, the product was transferred back to the feeding tank for a second, and third, pass. After each pass, a sample of the product was visually examined for fisheyes, none of which were found in the samples.

Sample 4: 3 lb/bbl POLYPAC® UL, 1 lb/bbl DUO-VIS® in Gel Slurry

A flow of 100 kg of Sample 1 gel slurry was established in the mixing reactor system described above. POLYPAC® UL (polyanionic cellulose) (0.572 kg) and DUO-VIS® (xanthan gum) (0.191 kg) were added to the gel flow and the sample was fainted by aerating/injecting steam into the flow. Steam was injected at a rate of 3.2-0.3 kg/min with a pressure of 5 bar for 30 seconds, thus injecting 1.5 kg of steam. After the first pass, the product was sent directly to the feeding tank instead of the receiving tank, so no samples would be taken on the fly. Subsequent passes were attempted but not possible due to back pressure, causing the material to blow out from the hopper.

Sample 5: 1 lb/bbl Scleroglucan

A gel slurry was formed by adding scleroglucan (0.286 kg) to a fresh water flow (98.2 kg) and aerating/injecting steam into the flow using a mixing reactor system as described above. Steam was injected at a rate of 3.2-0.3 kg/min with a pressure of 5 bar for 30 seconds, thus injecting 1.5 kg of steam and forming a 100 kg gel slurry sample. The sample was subjected to three passes in the mixing reactor.

Sample 6: 2 lb/bbl Scleroglucan

A gel slurry was formed by adding scleroglucan (0.572 kg) to a fresh water flow (97.9 kg) and aerating/injecting steam into the flow using a mixing reactor system as described above. Steam was injected at a rate of 3.2-0.3 kg/min with a pressure of 5 bar for 30 seconds, thus injecting 1.5 kg of steam and forming a 100 kg gel slurry sample. The sample was subjected to three passes in the mixing reactor.

Sample 7: 1 lb/bbl Scleroglucan, pH 5

A gel slurry was formed by adding scleroglucan (0.286 kg) to a fresh water flow (98.2 kg) having its pH adjusted to 5.0 using 32 g of citric acid and aerating/injecting steam into the flow using a mixing reactor system as described above. Steam was injected at a rate of 3.2-0.3 kg/min with a pressure of 5 bar for 30 seconds, thus injecting 1.5 kg of steam and forming a 100 kg gel slurry sample. The sample was subjected to three passes in the mixing reactor.

The rheological properties of the mixed fluids in each of Samples 1-7 were determined using a Fann Model 35 Viscometer, available from Fann Instrument Company at 120° F. and a Brookfield Viscometer for Low Shear rate viscosity at room temperature. The samples were also subjected to a low pressure, low temperature filtration test to measure the static filtration behavior of the fluid at room temperature and 100 psi, according to specifications set by the API Fluid Loss test procedures. The gel strengths (i.e., measure of the suspending characteristics or thixotropic properties of a fluid) of the samples were evaluated by the 10 second and 10 minute gel strengths in pounds per 100 square feet in accordance with the procedures in API Bulletin RP 13B-2, 1990. The results of the tests are shown below in Table 1a-b.

TABLE 1a

| | Sample | | | | | | | | |
|---|---|---|---|---|---|---|---|---|---|
| | 1 | 2.1 | 2.2 | 2.3 | 3.1 | 3.2 | 3.3 | 4.1 | 4.2 |
| Funnel Viscosity (sec) | 63 | 130 | 100 | 70 | 130 | 215 | 160 | 488 | 410 |
| Mud Weight (ppg) | 8.45 | 8.55 | 8.60 | 8.60 | 8.50 | 8.50 | 8.50− | 8.50− | 8.60+ |
| 600 rpm | 23 | 38 | 33 | 30 | 40 | 50 | 46 | 67 | 64 |
| 300 rpm | 17 | 26 | 22 | 20 | 27 | 34 | 31 | 47 | 44 |
| 200 rpm | 15 | 20 | 17 | 16 | 20 | 28 | 25 | 39 | 36 |
| 100 rpm | 12 | 15 | 12 | 12 | 13 | 21 | 18 | 29 | 26 |
| 6 rpm | 10 | 6 | 4 | 4 | 5 | 9 | 7 | 12 | 10 |
| 3 rpm | 10 | 6 | 3 | 4 | 4 | 8 | 6 | 10 | 9 |
| Gels 10" (lbs/100 $ft^2$) | 16 | 7 | 6 | 6 | 5 | 9 | 7 | 12 | 11 |
| Gels 10' (lbs/100 $ft^2$) | 32 | 18 | 17 | 15 | 17 | 22 | 16 | 27 | 25 |
| PV (cP) | 6 | 12 | 11 | 10 | 13 | 16 | 15 | 20 | 20 |
| YP (cP) | 11 | 14 | 11 | 10 | 14 | 18 | 16 | 27 | 24 |
| Brookfield 0.3 rpm - 1 min (cP) | 24000 | 22400 | 24700 | 23200 | 27000 | 38900 | 44900 | 55400 | 59100 |
| Brookfield 0.3 rpm - 2 min (cP) | 23000 | 26800 | 28100 | 24900 | 31300 | 43800 | 50900 | 62700 | 66600 |
| Brookfield 0.3 rpm - 3 min (cP) | 23700 | 28700 | 29500 | 26500 | 33300 | 46000 | 53800 | 66800 | 70500 |
| pH | 9.70 | 8.65 | 8.65 | 8.53 | 8.73 | 8.16 | 8.12 | 7.86 | 7.83 |
| API FL (mL) | 21.5 | 9.5 | 9.6 | 9.5 | 10.4 | 8.2 | 8.4 | 9.3 | 8.5 |

TABLE 1b

| | Sample | | | | | | | | |
|---|---|---|---|---|---|---|---|---|---|
| | 5.1 | 5.2 | 5.3 | 6.1 | 6.2 | 6.3 | 7.1 | 7.2 | 7.3 |
| Funnel Viscosity (sec) | 31 | 37 | 37 | 36 | 39 | 40 | 35 | 39 | 39 |
| Mud Weight (ppg) | 8.30 | 8.30 | 8.30 | 8.30 | 8.30 | 8.30 | 8.30 | 8.30 | 8.30 |
| 600 rpm | 2 | 11 | 9 | 13 | 19 | 17 | 6 | 11 | 9 |
| 300 rpm | 1 | 8 | 6 | 10 | 15 | 13 | 4 | 9 | 7 |
| 200 rpm | 0 | 7 | 5 | 8 | 13 | 12 | 3 | 7 | 5 |
| 100 rpm | 0 | 6 | 4 | 6 | 12 | 10 | 3 | 6 | 4 |
| 6 rpm | 0 | 3 | 2 | 1 | 7 | 5 | 1 | 3 | 2 |
| 3 rpm | 0 | 3 | 2 | 1 | 6 | 4 | 1 | 3 | 2 |
| Gels 10" (lbs/100 $ft^2$) | 0 | 3 | 4 | 2 | 6 | 4 | 1 | 3 | 2 |
| Gels 10' (lbs/100 $ft^2$) | 1 | 3 | 5 | 2 | 9 | 4 | 2 | 3 | 2 |
| PV (cP) | 1 | 3 | 3 | 3 | 4 | 4 | 2 | 2 | 2 |
| YP (cP) | 0 | 5 | 3 | 7 | 11 | 9 | 2 | 7 | 5 |
| Brookfield 0.3 rpm - 1 min (cP) | 60 | 720 | 700 | 180 | 6660 | 1300 | 1460 | 4640 | 3560 |
| Brookfield 0.3 rpm - 2 min (cP) | 60 | 740 | 1260 | 120 | 7260 | 1440 | 1560 | 4820 | 3580 |
| Brookfield 0.3 rpm - 3 min (cP) | 60 | 800 | 1260 | 120 | 7460 | 1460 | 1600 | 4900 | 3500 |
| pH | — | — | — | — | — | — | — | — | — |
| API FL (mL) | — | — | — | — | — | — | — | — | — |

Sample 8A: 3 lb/bbl DUO-VIS®

Water was first treated with M-I CIDE™ (0.05 vol %), a biocide available from M-I LLC, Houston, Tex. DUO-VIS® (xanthan gum) was added to the water flow to reach a concentration of 3 lb/bbl, and the sample was formed by aerating/injecting steam into the flow. Steam was injected at a rate of 3.2-0.3 kg/min with a pressure of 5 bar for 30 seconds, thus injecting 1.5 kg of steam. The sample was subjected to three passes in the mixing reactor.

Sample 9A: 5 lb/bbl HEC

Water was first treated with M-I CIDE™ (0.05 vol %), a biocide. Hydroxyethylcellulouse (HEC) was added to the water flow to reach a concentration of 5 lb/bbl, and the sample was formed by aerating/injecting steam into the flow. Steam was injected at a rate of 3.2-0.3 kg/min with a pressure of 5 bar for 30 seconds, thus injecting 1.5 kg of steam. The sample was subjected to three passes in the mixing reactor.

The rheological properties of the mixed fluids in each of Samples 8A and 9A were determined using a Fann Model 35 Viscometer, available from Fann Instrument Company at 120° F. a Brookfield Viscometer for Low Shear rate viscosity at room temperature. The samples were also subjected to a low pressure, low temperature filtration test to measure the filtration behavior of the fluid at room temperature and 100 psi, according to specifications set by the API Fluid Loss test procedures. The results are shown in Table 2a below.

TABLE 2a

| | Sample | | | | | |
|---|---|---|---|---|---|---|
| | 8A.1 | 8A.2 | 8A.3 | 9A.1 | 9A.2 | 9A.3 |
| Funnel Viscosity (sec) | — | — | — | — | — | — |
| Mud Weight (ppg) | 8.30 | 8.30 | 8.30 | 8.30 | 8.30 | 8.30 |

TABLE 2a-continued

| | Sample | | | | | |
|---|---|---|---|---|---|---|
| | 8A.1 | 8A.2 | 8A.3 | 9A.1 | 9A.2 | 9A.3 |
| 600 rpm | 64 | 55 | 44 | — | 280 | 291 |
| 300 rpm | 54 | 48 | 38 | 263 | 234 | 242 |
| 200 rpm | 49 | 44 | 35 | 236 | 209 | 216 |
| 100 rpm | 42 | 38 | 31 | 193 | 169 | 176 |
| 6 rpm | 26 | 22 | 22 | 64 | 52 | 54 |
| 3 rpm | 23 | 20 | 20 | 44 | 36 | 36 |
| Gels 10" (lbs/100 $ft^2$) | 24 | 21 | 21 | 44 | 35 | 36 |
| Gels 10' (lbs/100 $ft^2$) | 24 | 23 | 21 | 46 | 36 | 36 |
| PV (cP) | 10 | 7 | 6 | — | 46 | 49 |
| YP (cP) | 4 | 41 | 32 | — | 188 | 193 |
| Brookfield 0.3 rpm - 1 min (cP) | 37500 | 23400 | 21600 | 93800 | 79700 | 76500 |
| Brookfield 0.3 rpm - 2 min (cP) | 41100 | 24200 | 21700 | — | 100000 | 90400 |
| Brookfield 0.3 rpm - 3 min (cP) | 41800 | 24200 | 21800 | — | — | 91300 |
| pH | 9.16 | 9.18 | 9.18 | 8.883 | 9.01 | 9.03 |

The tests were repeated after Samples 8A and 9A were subjected to heat-rolling for 16 hours at 150° F. The results are shown below in Table 2b.

TABLE 2b

| | Sample | | | | | |
|---|---|---|---|---|---|---|
| | 8A.1 | 8A.2 | 8A.3 | 9A.1 | 9A.2 | 9A.3 |
| Funnel Viscosity (sec) | — | — | — | — | — | — |
| Mud Weight (ppg) | 8.30 | 8.30 | 8.30 | 8.30 | 8.30 | 8.30 |
| 600 rpm | 47 | 46 | 38 | 258 | 261 | 256 |
| 300 rpm | 41 | 40 | 34 | 212 | 214 | 207 |
| 200 rpm | 39 | 38 | 32 | 190 | 190 | 184 |
| 100 rpm | 35 | 34 | 29 | 154 | 152 | 147 |
| 6 rpm | 24 | 22 | 21 | 49 | 45 | 43 |
| 3 rpm | 21 | 20 | 18 | 34 | 31 | 29 |
| Gels 10" (lbs/100 $ft^2$) | 21 | 20 | 18 | 34 | 31 | 29 |
| Gels 10' (lbs/100 $ft^2$) | 26 | 25 | 25 | 36 | 31 | 30 |
| PV (cP) | 6 | 6 | 4 | 46 | 47 | 49 |
| YP (cP) | 35 | 34 | 30 | 166 | 167 | 158 |
| Brookfield 0.3 rpm - 1 min (cP) | 32500 | 22300 | 20900 | 80400 | 76000 | 71500 |
| Brookfield 0.3 rpm - 2 min (cP) | 34500 | 2300 | 21000 | — | 91000 | 86800 |
| Brookfield 0.3 rpm - 3 min (cP) | 34200 | 22800 | 21100 | — | 93800 | 86600 |
| pH | 9.31 | 9.21 | 9.20 | 7.56 | 7.52 | 7.77 |

Samples 8B (3 lb/bbl DUO-VIS®) and 9B (5 lb/bbl HEC)

In order to determine the ability of the disclosed system to optimize the rheological properties of the mixed fluids, the mud formulations of Samples 8A and 9A were also formed using a conventional Silverson mixer at 4000 rpm for 1 hour to produce Samples 8B and 9B. The rheological properties of the mixed fluids in each of Samples 8B and 9B were determined using a Fann Model 35 Viscometer, available from Fann Instrument Company at 120° F. and a Brookfield Viscometer for Low Shear rate viscosity at room temperature. The samples were also subjected to a low pressure, low temperature filtration test to measure the filtration behavior of the fluid at room temperature and 100 psi, according to specifications set by the API Fluid Loss test procedures. The tests were each performed twice before heat rolling (BHR) and after heat rolling (AHR) for 16 hours at 150° F. Each repetition showed identical results to the first test. The results are shown in Table 3 below.

TABLE 3

| Sample | 8B: BHR | 8B: AHR | 9B: BHR | 9B: AHR |
|---|---|---|---|---|
| Funnel Viscosity (sec) | 76 | 81 | 9960 | 7200 |
| Mud Weight (ppg) | 8.3 | 8.3 | 8.3 | 8.3 |
| 600 rpm | 39 | 33 | — | — |
| 300 rpm | 32 | 27 | — | 295 |
| 200 rpm | 29 | 24 | 280 | 266 |
| 100 rpm | 25 | 20 | 234 | 222 |
| 6 rpm | 15 | 13 | 90 | 78 |
| 3 rpm | 14 | 11 | 64 | 55 |
| Gels 10" (lbs/100 $ft^2$) | 17 | 14 | 65 | 55 |
| Gels 10' (lbs/100 $ft^2$) | 23 | 16 | 65 | 53 |
| PV (cP) | 7 | 6 | — | — |
| YP (cP) | 25 | 21 | — | — |
| Brookfield 0.3 rpm - 1 min (cP) | 49800 | 30100 | 82800 | 37300 |
| Brookfield 0.3 rpm - 2 min (cP) | 51700 | 30000 | 77700 | 39700 |
| Brookfield 0.3 rpm - 3 min (cP) | 57000 | 30000 | 82000 | 40100 |
| pH | 6.91 | 6.16 | 7.37 | 6.38 |
| API FL (mL) | 33.0 | — | 55.0 | 100 |

Samples 8C-D (3 lb/bbl DUO-VIS®) and 9C-D (5 lb/bbl HEC)

For samples 8C and 9C, the mud formulations described in Samples 8A and 9A were formed in a 4 bbl batch using a Silverson mixer fitted with a round holed shear head at 6000 rpm for 15 min, to simulate the API method for water-based mud mixing with reduced mixing time but increased shear/unit volume. For samples 8D and 9D, the mud formulations described in Samples 8A and 9A were mixed using a Heidoiph paddle mixer for 15 min to show the effect of reduced shear mixing.

The rheological properties of the mixed fluids in each of Samples 8C-D and 9C-D were determined using a Fann Model 35 Viscometer, available from Fann Instrument Company at 120° F. and a Brookfield Viscometer for Low Shear rate viscosity at room temperature. The results are shown in Table 4a below.

TABLE 4a

| Sample | 8C | 8D | 9C | 9D |
|---|---|---|---|---|
| Funnel Viscosity (sec) | 81 | 86 | — | — |
| Mud Weight (ppg) | 8.3 | 8.3 | 8.3 | 8.3 |
| 600 rpm | 34 | 42 | — | — |
| 300 rpm | 31 | 35 | — | 280 |
| 200 rpm | 29 | 33 | 271 | 256 |
| 100 rpm | 26 | 29 | 227 | 215 |
| 6 rpm | 17 | 18 | 84 | 83 |
| 3 rpm | 15 | 16 | 60 | 60 |
| Gels 10" (lbs/100 $ft^2$) | 19 | 19 | 60 | 60 |
| Gels 10' (lbs/100 $ft^2$) | 26 | 26 | 60 | 60 |
| PV (cP) | 3 | 7 | — | — |
| YP (cP) | 28 | 26 | — | — |
| Brookfield 0.3 rpm - 1 min (cP) | 56000 | 72900 | 60000 | 64900 |
| Brookfield 0.3 rpm - 2 min (cP) | 49100 | 64100 | 72800 | 81900 |
| Brookfield 0.3 rpm - 3 min (cP) | 46700 | 62700 | 76800 | 88200 |
| pH | 8.71 | 8.63 | 9.21 | 9.08 |

The tests were repeated after Samples 8C-D and 9C-D were subjected to heat-rolling for 16 hours at 150° F. The results are shown below in Table 4b.

TABLE 4b

| Sample | 8C | 8D | 9C | 9D |
|---|---|---|---|---|
| Funnel Viscosity (sec) | 83 | 86 | — | — |
| Mud Weight (ppg) | 8.3 | 8.3 | 8.3 | 8.3 |
| 600 rpm | 36 | 40 | — | 288 |
| 300 rpm | 31 | 35 | 254 | 239 |
| 200 rpm | 29 | 32 | 227 | 214 |
| 100 rpm | 25 | 28 | 185 | 173 |
| 6 rpm | 16 | 17 | 62 | 56 |
| 3 rpm | 14 | 15 | 44 | 39 |
| Gels 10" (lbs/100 $ft^2$) | 16 | 16 | 44 | 39 |
| Gels 10' (lbs/100 $ft^2$) | 24 | 20 | 44 | 39 |
| PV (cP) | 5 | 5 | — | 49 |
| YP (cP) | 26 | 30 | 4 | 39 |
| Brookfield 0.3 rpm - 1 min (cP) | 60000 | 66000 | 36400 | 36100 |
| Brookfield 0.3 rpm - 2 min (cP) | 60400 | 71300 | 35000 | 36600 |
| Brookfield 0.3 rpm - 3 min (cP) | 59300 | 71000 | 36200 | 36300 |
| pH | 9.28 | 9.01 | 9.85 | 9.51 |

It can be shown from the absence of fisheyes in the visual examination of the samples and the above results, that the drilling fluids may be more homogenously mixed using the methods and systems disclosed herein as compared to conventional mixing methods that produce drilling fluids encumbered by fisheyes. Additionally, in comparing the rheological properties of fluids mixed by a system of the present disclosure to fluid prepared by conventional mixing techniques, the fluids of the present disclosure showed improvements in the fluids' rheological properties without downhole circulation.

Embodiments disclosed herein may provide for at least one of the following advantages. The methods disclosed herein may provide for a drilling fluid that may be substantially homogeneously mixed and substantially free of fisheyes. In enabling the formation of drilling fluids without agglomerates, the cost efficiency of the additives may be optimized by reducing the amount of additives that is filtered out by shale shakers prior to recirculation of a drilling fluid downhole. Additionally, performance of the drilling fluids downhole may be increased due to the decreased amount of agglomerated material. Increases in performance may result from the better achievement of the fluid's maximum rheological capabilities. Further cost efficiency may also be achieved by allowing for the modification of existing hopper systems to provide a substantially homogenous mixed drilling fluid.

While the present disclosure has been described with respect to a limited number of embodiments, those skilled in the art, having benefit of this disclosure, will appreciate that other embodiments can be devised which do not depart from the scope of the invention as described herein. Accordingly, the scope of the invention should be limited only by the attached claims.

What is claimed:

1. A system for mixing drilling fluids, comprising:

a fluid supply tank, having an agitator therein, for supplying an unmixed drilling fluid;

a mixing reactor fluidly connected to the fluid supply tank, the mixing reactor comprising:

an intake and an outlet;

a mixing chamber connected to the intake and the outlet by a fluid line;

an inlet for injecting a compressible driving fluid into the mixing chamber; and an inlet for injecting an aerating gas into the mixing chamber;

wherein the unmixed drilling fluid is pumped into the mixing reactor by a pump connected to the fluid line and mixed drilling fluids exits the mixing reactor, and further wherein the mixing chamber is configured such that a velocity of the compressible driving fluid entering the mixing chamber increases to form a supersonic energy wave or shock zone in the mixing chamber for mixing the unmixed drilling fluid to form the mixed drilling fluid.

2. The system of claim 1, further comprising:

a hopper operatively connected to the fluid supply tank for supplying drilling fluid components to the unmixed drilling fluid.

3. The system of claim 1, wherein the unmixed drilling fluid comprises a base fluid, and wherein the system further comprises a hopper fluidly connected to a fluid line between the fluid supply tank and the mixing reactor for supplying drilling fluid additives to the unmixed drilling fluid.

4. The system of claim 1, further comprising:

a recycling line fluidly connecting the outlet of the mixing reactor to the intake of the mixing reactor.

5. The system of claim 1, further comprising:

a receiving tank fluidly connected to the mixing reactor for collecting the mixed drilling fluid.

6. The system of claim 1, further comprising:

a pump fluidly connected to the fluid supply tank and the mixing reactor for pumping unmixed drilling fluid to the mixing reactor.

* * * * *